United States Patent [19]

Shannon, Jr. et al.

[11] 4,091,867

[45] May 30, 1978

[54] FLEXIBLE CONDUIT INJECTION SYSTEM

[75] Inventors: Frederick E. Shannon, Jr., Carrollton; Tibor Laky, Dallas, both of Tex.

[73] Assignee: Otis Engineering Corporation, Dallas, Tex.

[21] Appl. No.: 759,464

[22] Filed: Jan. 14, 1977

[51] Int. Cl.[2] ..... E21B 19/08

[52] U.S. Cl. ..... 166/77; 166/84

[58] Field of Search ..... 166/77, 71, 82, 84, 166/315; 175/103

[56] References Cited

U.S. PATENT DOCUMENTS

| | | | |
|---|---|---|---|
| 2,810,439 | 10/1957 | McCullough et al. | 166/77 |
| 3,363,880 | 1/1968 | Blagg | 166/77 |
| 3,920,076 | 11/1975 | Laky | 166/77 |

*Primary Examiner*—James A. Leppink
*Attorney, Agent, or Firm*—Vinson & Elkins

[57] ABSTRACT

A system for injecting a flexible conduit into a well against the pressure of the well. The system includes a connection which is in communication with the well and aligned with the well; a drive mechanism also in communication with the well but not aligned with the well; and a curved guide between the connection and the drive mechanism for guiding movement of the flexible conduit between a direction aligned with the drive mechanism and a direction aligned with the well. This abstract is neither intended to define the scope of the invention, which, of course, is measured by the claims, nor is it intended to be limiting in any way.

9 Claims, 4 Drawing Figures

FLEXIBLE CONDUIT INJECTION SYSTEM

BACKGROUND OF THE INVENTION

A. Field of the Invention

This invention relates to a system for injecting a soft flexible conduit into a well against the pressure of the well. It also relates to a curved guide for guiding a soft flexible conduit as its direction of movement changes.

B. The Prior Art

Some oil and gas well sub-surface operations are performed with conduit that has been inserted into the well. Fluids are pumped through the conduit for treating the well.

Generally, conduits with a steel wire sheath have been used for such operations. The steel sheath protects the outer surface of the conduit. Such conduits can therefore be handled by link belt chain drive mechanisms which force the conduit into the well. However, there are numerous drawbacks to the use of a conduit with a steel wire protective sheath. Because of the steel sheath, the conduit is not flexible enough to be wound on a small (two to three foot) drum for storage. Instead it must be wound on a large (eight to ten foot) drum. The link belt chain drive mechanisms are heavy. To use such a drive mechanism, it must be positioned directly over the wellhead. Therefore, a hoisting mechanism must be employed to properly position the drive mechanism. The large heavy drum, heavy link belt drive mechanism and hoisting equipment all required to insert a steel sheathed conduit into a well, renders such an injection system cumbersome, difficult to transfer from one well to another, and expensive.

Additionally, the steel sheath for the conduit undergoes severe bending when the conduit is wound on even a large drum. The severe bending causes the steel sheath to fail. Consequently, to guard against failure during use, a steel sheathed conduit is inserted into a well only seven to ten times before being taken out of service and replaced.

The required large, heavy equipment for inserting a steel sheathed conduit into a well, and the limited use obtained from such a conduit, have encouraged the development of a system for injecting a flexible conduit, such as a hose, into a well. The use of a hose as the flexible conduit creates certain unique requirements for the injection system. Conventional hoses have been designed with one criterion, to hold internal pressure. They have not been designed to protect the outside from wear due to handling. Therefore, if a conventional hose is to be injected into a well, the injection system has to gently handle the hose while injecting it against well pressure into the well.

One injection system for a flexible hose is disclosed in U.S. Pat. No. 3,866,679 for "APPARATUS FOR INSERTING FLEXIBLE PIPE INTO WELLS", issued Feb. 18, 1975, to Tibor Laky. The disclosed system includes a drive mechanism in communication with the well. The hose passes through the drive mechanism where it is engaged and either injected into the well against the well pressure or retrieved from the well. To minimize wear and damage to the hose's exterior as it moves from the drive mechanism into the well, the drive mechanism is aligned with and above the well. From the drive mechanism, the hose moves straight into the well.

The system as disclosed in the aforementioned Laky U.S. Pat. No. 3,866,679 patent would function to inject a hose into the well. However, it has a few practical limitations. The drive mechanism, while considerably lighter than a link belt drive mechanism for a steel sheathed conduit, is still heavy. It is estimated that such a unit would weigh on the order of 1,500 pounds. The disclosed system positions this drive mechanism off of the ground above the well on top of a lubricator. To so position the drive mechanism requires hoisting equipment and/or an excessive amount of structural support members. The hoisting equipment and structural support members complicate movement and use of the system at different well head locations. The complications increase the cost per well for using the system and decrease the number of wells that may be treated by one set of apparatus.

OBJECTS OF THE INVENTION

It is an object of this invention to provide a system for injecting a flexible conduit into a well which is an improvement over the system disclosed in the aforementioned Laky U.S. Pat. No. 3,866,679 patent.

It is another object of this invention to provide a system for injecting a flexible conduit into a well that does not require the hoisting of heavy equipment.

It is another object of this invention to provide a system for injecting flexible conduit into a well that enables the placement of heavy equipment near the ground where the required support for such heavy equipment is minimal.

It is another object of this invention to provide a system for injecting a flexible conduit into a well that is readily movable from one wellhead location to another.

It is another object of this invention to provide a system for injecting a flexible conduit into a well that includes a guide for guiding the movement of the flexible conduit between the drive mechanism where the conduit is not in alignment with the well and a position where the conduit is in alignment with the well.

It is another object of this invention to provide a curved guide that guides the movement of a flexible conduit around a radius of curvature with minimal frictional engagement with the conduit and with minimal damage to the conduit.

It is another object of this invention to provide a curved guide that is easy to assemble and which guides a movement of a flexible member around a radius of curvature with minimal damage to the member.

It is another object of this invention to provide a curved guide capable of withstanding the pressure of a well through which a flexible member may pass with minimal resistance and damage.

It is another object of this invention to provide a curved guide capable of withstanding the pressure of a well to enable a flexible conduit to be injected into the well which guide enables movement of the flexible conduit around a radius of curvature with minimal resistance and damage.

These and other objects, features, and advantages, of this invention will be apparent from the detailed description, drawings, and appended claims.

BRIEF DESCRIPTION OF THE DRAWINGS

In the drawings wherein like numerals indicate like parts, and wherein an illustrative embodiment of this invention is shown.

DESCRIPTION OF THE PREFERRED EMBODIMENT

Figure 1:
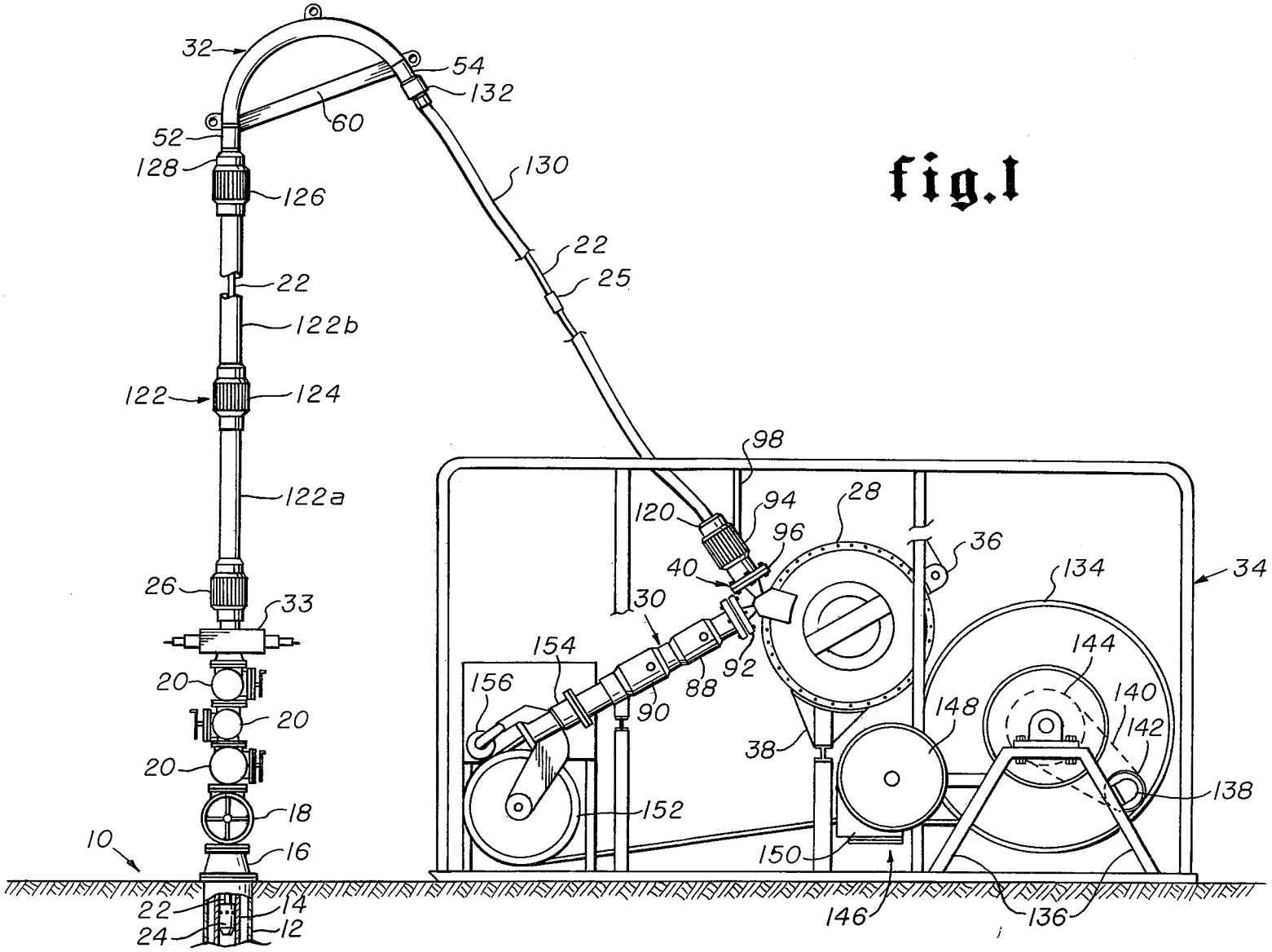
FIG. 1 is a schematic view of a well and a system for injecting flexible conduit therein, which system is constructed in accordance with this invention.

In FIG. 1, a well 10 is illustrated. The well 10 has a surface casing 12 through which a production tubing 14 extends from the wellhead 16 to the producing formation (not shown). Above the wellhead 16 is the usual christmas tree including the master valve 18 and one or more tubing flow valves 20.

Utilizing the system of this invention, a flexible conduit, such as hose 22, may be run into the well 10. The flexible conduit 22 will move through the christmas tree while the master valve 18 and the tubing flow valves 20 are open and will be injected into the well 10 against well pressure. Once in the well 10, the flexible conduit 22 may move through the bore of the production tubing 14. At the end of the flexible conduit 22 is a nozzle 24. The flexible conduit 22 will be used to circulate fluids within the well to wash out sand bridges or permit the well to be otherwise treated.

The flexible conduit 22 to be run into the well 10 may comprise a small diameter (1 inch), soft, flexible hose. The flexible conduit 22 preferably is capable of withstanding high internal pressures on the order of 5,000 psi. It may comprise numerous sections of hose which are joined together by couplings 25. The couplings 25 may be as disclosed in the aforementioned U.S. Pat. No. 3,866,679 to Laky, the entire disclosure of which is hereby incorporated by reference for all purposes.

To inject the conduit 22 into the well 10, the injection system includes connector means 26 through which the conduit 22 passes as it moves into and out of the well 10, injector drive means 28 for positively driving the flexible conduit 22 into and out of the well 10, seal means 30 for sealing around the flexible conduit and preventing well fluids from escaping, and curved guide means 32 for guiding the movement of the flexible conduit 22 between the drive means 28 where the conduit 22 is not aligned with the well 10 and connector means 26 where the conduit 22 is aligned with the well 10.

The connector means 26 is attached to the blow-out-preventor 33 on the top of the christmas tree and is in communication therethrough with the well 10. Through connector means 22 a passage is provided for moving conduit 22 into and out of the well 10.

One form of connector means 26 is an "Otis Quick Union" connector as shown on page 3984 of the 1974–1975 "COMPOSITE CATALOG OF OIL FIELD EQUIPMENT & SERVICES". Another form is disclosed in the aforementioned Laky U.S. Pat. No. 3,866,679. Both of these connector means include a bore through which the conduit 22 passes.

The injector drive means 28 engages the flexible conduit 22 and provides the positive driving force for moving the conduit 22 into and out of the well. The injector drive means 28 may be the same as that disclosed in the aforementioned Laky U.S. Pat. No. 3,866,679. As such, it will be in fluid communication with the well and will include a torous pressure chamber and a capstan drive means within the torous pressure chamber. The flexible conduit 22 will be fed through the torous pressure chamber and therein engaged by the capstan drive mechanism. The injector drive means 28 operates in the manner explained in the aforementioned Laky U.S. Pat. No. 3,866,679 to inject the flexible conduit 22 into the well 10 against well pressure and to retrieve the flexible conduit 22 from the well 10.

It will be noted that the injector drive means 28 is mounted on skid frame means 34. Appropriate mounting brackets 36 and 38 of the skid frame means 34 support the injector drive means 28 and secure it to skid frame means 34. With the injector drive means supported on a separate skid frame means 34 instead of being positioned over the wellhead and christmas tree as in the aforementioned Laky U.S. Pat. No. 3,688,679, the injector drive means 22 does not have to be hoisted into position and may be readily moved from one well to another. However, it will be noted that the outlet 40 of the injector drive means is not aligned with the well. When the flexible conduit leaves the injector drive means 28, its movement will therefore also be in a direction that is not in alignment with the well.

Curved guide means 32 in fluid communication with both connector means 26 and injector drive means 28 guides the movement of flexible conduit 22 between a direction which is aligned with injector drive means 28 and a direction which is aligned with the well 10. While the flexible conduit 22 is being injected into or retrieved from the well, well pressure will be effective upon the exterior of the conduit 22. To minimize wear damage to the conduit's exterior due to this well pressure, the curved guide means 32 preferably provides a substantially precise curve along which the conduit 22 is guided and the curved guide means 32 preferably provides minimal frictional engagement with the conduit 22.

Figure 2:
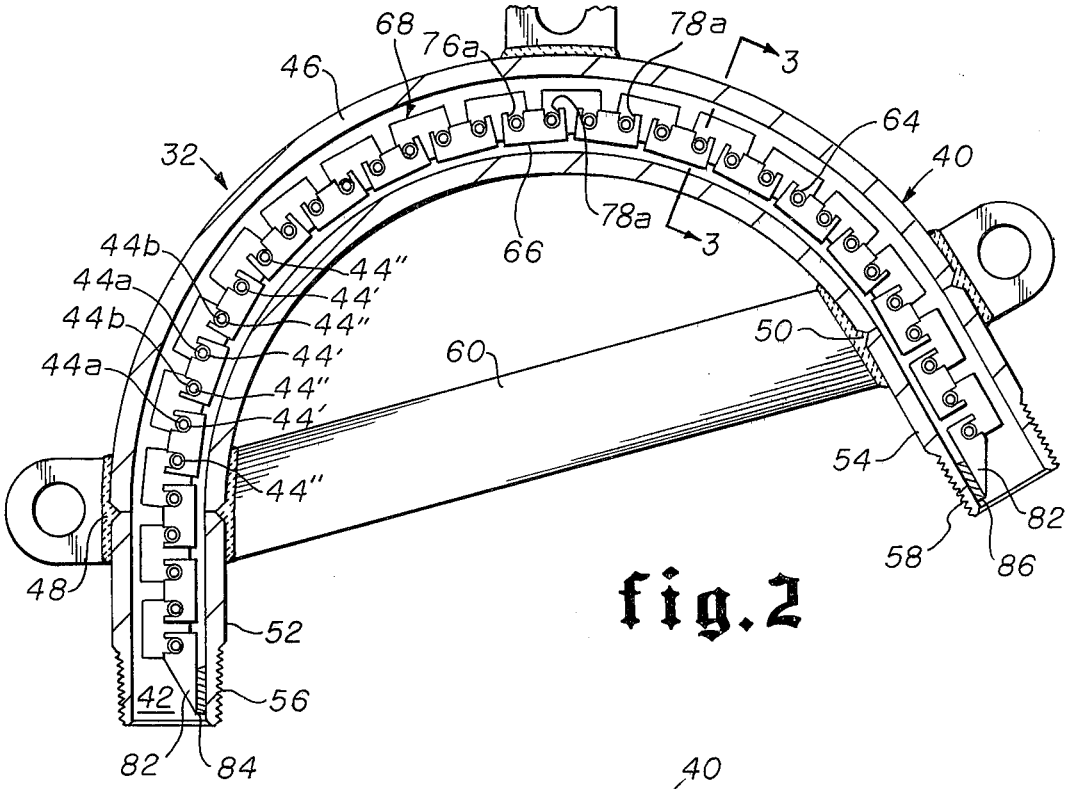
FIG. 2 is a cross-sectional view, taken along line 2—2 of FIG. 3, of a curved guide of this invention.
Figure 3:
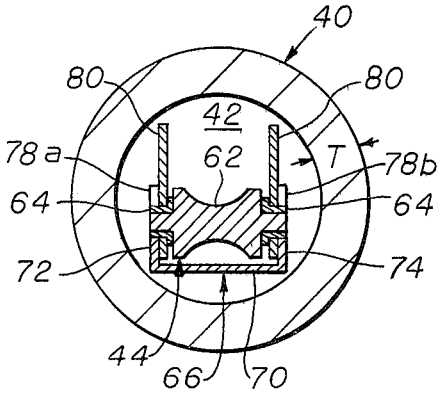
FIG. 3 is a cross-sectional view, taken along line 3—3 of FIG. 2, of the curved guide.

The detailed structure of a preferred form of a curved guide means 32 is illustrated in FIGS. 2 and 3. The curved guide means 32 includes housing means 40 having an internal passage 42 for the conduit 22, roller means 44 disposed within the internal passage for engaging the conduit 22 and guiding its passage through the internal passage 42, and mounting means for mounting the roller means 44 within the internal passage 42.

The housing means 40 is curved in a substantially precise hyperbolic curve to facilitate ease in mounting the roller means 44 along a substantially hyperbolic curve. Since the well pressure will be effective within the internal passage 42 of the housing means 40, the housing means 40 has a wall thickness T capable of withstanding the stresses imposed by the confined well pressure.

The housing means 40 may be formed by precisely bending a tube 46. During bending, care should be taken so as to not deform the circular cross-section of the internal passage 42. The tube 46 is bent until it forms a substantially precise hyperbolic curve. To the ends of the curved tube 46 are attached, as by weldments 48 and 50, connecting subs 52 and 54. Each connecting sub includes means, such as threads 56 and 58 respectively, to enable connection of housing means 40 to another member. A brace 60 may be welded between the ends of the curved tube 46 to maintain the tube 46 in its desired curved condition.

Roller means 44 are disposed within the internal passage 42 of housing means 40. They will engage the conduit 22 as it moves through the curved guide means 32. Preferably, a plurality of small, closely spaced roller means 44, each contoured to conform to the conduit 22, are positioned within the internal passage 42, so that the portion of the conduit that is within the curved guide means 32 is supported substantially along its entire length. Additionally, the plurality of roller means 44 are preferably mounted along a substantially precise hyperbolic curve so that the conduit 22 undergoes only an incremental change in direction of movement as it advances from one roller to the next. Such a plurality of roller means 44 are illustrated in FIGS. 2 and 3. As clearly seen in FIG. 3, each roller means 44 includes a central cylindrical portion having an outer surface 62 that is concave in cross-section. These concave surfaces 62 are contoured to conform to the exterior of the conduit 22 to provide a track for the conduit's movement through the internal passage 42.

Mounting means are provided for mounting the roller means 44 within the internal passage 42 of the housing means 40 along a substantially precise hyperbolic curve.

To enable free rotation of roller means 44, the mounting means includes bearing means 64 for each end of each roller means 44. In addition to the bearing means 64, the mounting means includes components which are simple to manufacture and easy to assemble. The assembled components comprise a chain-like structure made up of a plurality of roller housing means 66 and a plurality of link means 68. Each roller housing means comprises one segment of the chain-like structure and houses two roller means 44. Each link means 68 comprises another segment of the chain-like structure and links together two roller housing means 66. With this chain-like mounting means, the bearing means 64 may be journaled in either link means 68 or roller housing means 66. The illustrated bearing means 64, are journaled in link means 68.

Each roller housing means 66 comprises a short U-shaped segment having a base 70 and two upright legs 72 and 74. Two pairs of opposed slots **76*a*, 76*b* and 78*a*, 78*b*, respectively, are formed in the housing's upright legs 72 and 74. In FIG. 2 the one slot 76*a* and 78*a* of each pair of opposed slots in leg 72 is visible while in FIG. 3 the two slots 78*a* and 78*b* of one pair of slots is visible. The slots are sized so that when bearing means 64 are positioned upon the ends of a roller means 44, the bearing means 64 may be received within one pair of opposed slots to housing the roller means 44 within the roller housing means 66, as seen in FIG. 3. Thus, two roller means 44, each with bearing means 64 on their ends, may be positioned within one roller housing means 66 by sliding the respective bearing means 64** into a set of opposed slots.

The link means 68 links together two different roller housing means 66 by linking together two different roller means 44, each of which is housed in a different roller housing means 66. Thus, if the two roller means that are housed within each roller housing means 66 are designated 44' and 44" respectively, and the two roller means which are linked by each link means 68 are designated **44*a* and 44*b* respectively, it may be seen that any one roller means 44 is housed within one roller housing means 66 and linked to another roller housing means 66 by link means 68. Thus the two roller means 44*a* and 44*b* linked by any one link means 68 are housed in two adjacent roller housing means 66 and the two roller means 44' and 44" housed within any one roller housing means 66 are linked to the adjacent roller housing means by two different link means 68**.

The link means 68 may comprise a plurality of link plate means 80. Each link plate means 80 has two bearing means 64 journaled therein. Two opposed link plate means, as seen in FIG. 3, comprise one link means 68. One link plate means 80 has journaled therein two bearing means 64 for receiving one end of two roller means **44*a* and 44*b*. Its opposed link plate means 80 also has journaled therein two bearing means 64 for receiving the other end of the two roller means 44*a* and 44*b***.

The assembly of the roller means 44 and mounting means within the housing's internal passage 42 is relatively simple. Two bearing means 64 are journaled within each of the link plate means 80. One end of two roller means **44*a* and 44*b* is fitted into the bearing means 64 journaled in one link plate means 80. The other end of those two roller means 44*a* and 44*b* is fitted into the bearing means 64 journaled in another link plate means 80. One of those two roller means 44 is housed in one roller housing means 66 by sliding its protruding bearing means 64 into one set of opposed slots in the housing legs. Likewise, the other roller means 44 is housed in another roller housing means 66 by sliding its protruding bearing means 64 into one set of opposed slots of that housing's legs. This forms a chain-like structure comprising two roller housing means 66, two roller means 44 and one link means 68. Another set of two roller means 44 is linked between two link plate means 80 and is used to join a third roller housing means 44 to the chain-like assembly. The process is repeated until a sufficient length of mounted roller means 44 has been obtained. Preferably, the chain-like structure is inserted through the housing's internal passage 42 while it is being assembled. The end pieces of this chain-like assembly may comprise anchor housing means 82 which are formed like the roller housing means 66 except that each anchor housing means 82 houses only one roller means 44 and therefore includes only one pair of opposed slots. Each anchor housing means 82 may be attached to the housing means 40, as by weldment 84 and 86, to maintain the roller means 44** and mounting means in position.

With the curved guide means assembled, it may be used as a component of the tubing injector system to guide the movement of the flexible conduit between a direction of movement which is not aligned with the well and a direction of movement which is aligned with the well.

During the operation of the injection system of this invention, injector drive means 28 will be in fluid communication with the well. To prevent well fluids from escaping through injector drive means 28, seal means 30 seal around the flexible conduit 22 as it enters or leaves the injector drive means 28. The illustrated seal means 30 comprises two stuffing boxes 88 and 90 in tandem arrangement. One of the stuffing boxes 88 is attached to a flange 92 which defines the opening into the torous pressure chamber of injector drive means 28. The stuffing boxes 88 and 90 normally engage and seal around the flexible conduit 22. However, when a coupling 25 is moved through the seal means 30, one of the stuffing boxes is disengaged from the flexible conduit 22, the coupling 25 is moved therethrough, that one stuffing box is reengaged with the flexible conduit 22 behind the coupling 25, the other stuffing box is disengaged from the flexible conduit 22, the coupling 25 moved through it and this second stuffing box is reengaged with the flexible conduit 22.

The stuffing boxes 88 and 90 may comprise the stuffing boxes as disclosed in the aforementioned Laky U.S. Pat. No. 3,866.679.

While the conduit 22 is within the well, well fluids will collect on the conduit's exterior surface. Wiper means 94 strips these well fluids from the conduit 22 to prevent them from contaminating the torous chamber of injector drive means 28. Wiper means 94 may be positioned anywhere between injector drive means 28 and the well 10. The illustrated wiper means 94 is attached to the outlet flange 96 of injector drive means 28. There wiper means 94 can be supported on skid frame means 34 by brace 98. Additionally, at such a location, it can perform a seal like function of retarding fluid flow into or out of injector drive means 28.

Figure 4:
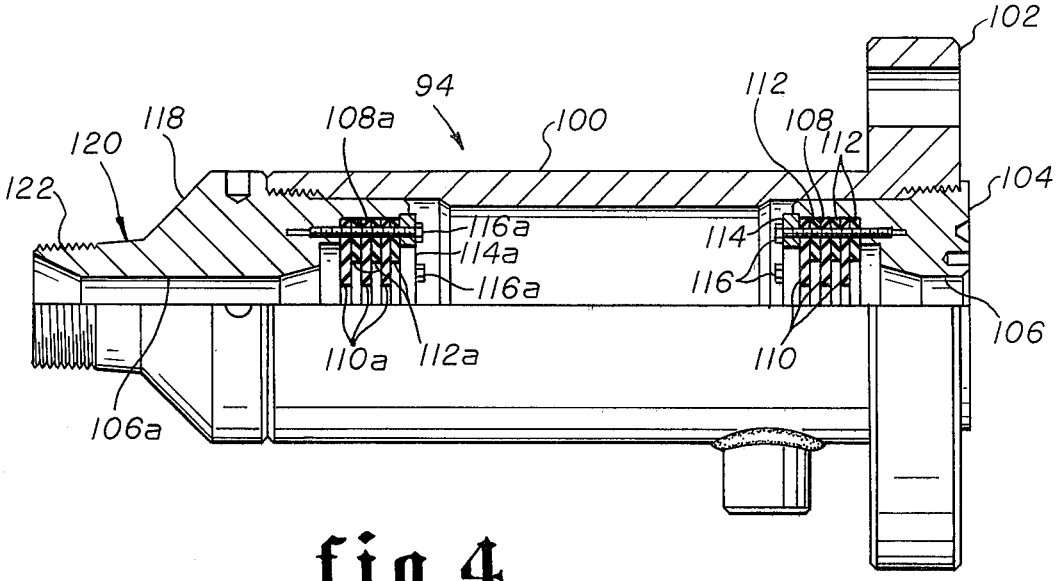
FIG. 4 is a quarter-sectional view of a wiper which is included in the injection system of this invention.

The detail structure means of wiper means 94 is illustrated in FIG. 4. Wiper means 94 comprises two spaced sets of wiper rings retained within a cylindrical housing 100. The cylindrical housing 100 includes a flange 102 for attaching wiper means 94 to the injector drive means 28. Within one end of the cylindrical housing 100 is received a packing retainer 104 for retaining one set of wiper rings. The packing retainer 104 includes a bore 106 through which the flexible conduit 22 may pass and an enlarged bore portion 108 in which one set of wiper rings are retained. The set of wiper rings comprises a plurality of elastic rings with alternating rings being of different internal diameters. When the conduit 22 passes through the rings, the rings 110 with the smaller internal diameter will flex, engage the conduit 22, and will strip fluids from the conduit's exterior surface. The other rings 112 with the larger internal diameter will maintain the spacing between the smaller internal diameter rings 110 so that they can effectively perform their stripping function. A retainer ring 114 may be placed over the end of the set of wiper rings to retain them in position within the enlarged bore 108 of the packing retainer 104. Through the retainer ring 114 and wiper rings 110 and 112 a plurality of bolts 116 may extend. The bolts 116 thread into the packing retainer 104 and maintain the retainer ring 114 and wiper rings 110 and 112 in position. At the other end of the cylindrical housing 100 is received another packing retainer 118. The packing retainer 114 is similar to the packing retainer 106 but for the addition of a nose 120. The nose 120 includes threads 122 for connecting another member to the wiper means 94. Since other components at this end of the wiper means are the same as those components previously discussed, they will not be further discussed. Their numeral designation corresponds to the designation of previously discussed corresponding components with the addition of the suffix *a*.

Complimenting the connector means 26, injector drive means 28, seal means 30 and curved guide means 32 of the system for injecting the flexible conduit 22 into the well 10 are various other apparatuses.

One such apparatus is the lubricator 122 above the christmas tree. The lubricator 122 enables the nozzle 24 to be positioned on the flexible conduit 22 and permits the nozzle 24 to be changed. As shown, the lubricator 122 may comprise several tubular sections 122*a* and 122*b* with coupling 124 therebetween. The tubular sections 122*a* and 122*b* have a working pressure rating higher than the wellhead pressure to enable confinement of well fluids during operation of the tubing injector system. The coupling 124 may be the same as connector means 26 previously described. As shown, the lower tubular section 122*a* of the lubricator 122 is connected to connector means 26. The flexible conduit 22 therefore moves straight through the lubricator 122, connector means 26, the blow-out-preventor 33, through the christmas tree and into the well 10.

A coupling 126, which may also be the same as a connector means 26 previously described, interconnects the top tubular section 122*b* of the lubricator 122 with a union 128 threaded on to the connecting sub 52 of curved guide means 32.

Tubular means 130 extend between another union 132 connected to the connecting sub 54 on the other end of the curved guide means 32 and nose 120 of the wiper means 94. This tubular means also has a working pressure greater than the wellhead pressure since it too will confine well fluids. The flexible conduit 22 will pass through this tubular means 130 as it moves between the curved guide means 32 and the injector drive means 28. If the connecting sub 54 of the curved guide means 32 and the nose 120 of wiper means 94 can be placed in alignment, this tubular means 130 may comprise a pipe section. However, if the connecting sub 54 and the nose cannot be so aligned, this tubular member 130 can be a flexible hose as shown.

Storage means 134, comprising a roll, stores a quantity of flexible conduit 22. Preferably, to provide a unitary flexible conduit injecting system which may be transported easily from well to well, the storage means 134 and the injector drive means 28 are both mounted on skid frame means 34. Mounting braces 136 are used to mount the storage means 134 on the skid frame means 34.

Motor means 138 for turning the storage means 134 may also be mounted on braces 136. For transmitting the driving power between the motor means 138 and the storage means 134, there is a chain drive 140 which engages a sprocket 142 of the motor means and a sprocket 144 of the storage means 134.

Means are provided to guide the movement of the flexible conduit 22 between the storage means 134 and the inlet 92 of the injector drive means 28. Since the conduit 22 will not be subject to well pressure during such movement, a curved guide means 32 will be unnecessary. However, the flexible conduit 22 must still be treated with care to avoid damage thereto. Several guiding apparatuses are used. As the flexible conduit 22 comes off of the storage means 134 it passes through a first hose guide assembly 146. This first hose guide assembly 120 may include two rollers 148 and 150 between which the flexible conduit passes.

Next, the flexible conduit 22 passes over a pulley 152. As the flexible conduit 22 comes off of the pulley 152, it is substantially in alignment with seal means 30 and the opening into injector drive means 28. However, to precisely align conduit 22 it is passed through a fair lead guide assembly 154.

To measure the amount of hose that has been injected into the well, a measuring device 156 is used. The measuring device 156 enables the operator to determine the depth to which the flexible conduit 22 has been injected into the well. It also enables him to determine, during retrieval of the flexible conduit 22 from the well, how much conduit 22 remains in the well so that retrieval operations may cease when the nozzle 24 is within the lubricator 94.

Control means, as disclosed in the aforementioned Laky U.S. Pat. No. 3,866,679 may be provided for controlling the operation of the injector drive means 28, the seal means 30, and the motor means 112 for the storage means 108. Additionally, fluid may be circulated into the flexible conduit 22 in the manner described in said patent.

The assembly of the injection system at a wellhead may be easily accomplished without the use of hoists or other heavy lifting apparatus. The skid frame means 24 supports all the heavy components of the system. It may be moved to the wellhead by truck and positioned near the christmas tree. A communicating passage from the well to the injector drive means 28, through which the flexible conduit 22 will pass, is prepared. The master valve 18 of the christmas tree is closed. The blow-out-preventor 33 is attached to the top of the christmas tree. The lubricator 122 is attached to the blow-out-preventor with connector means 26. Curved guide means 32 is attached to the top of the lubricator 122 by coupling 126. Tubular means 130 interconnects curved guide means 32 and injector drive means 28. Prior to opening the master valve the flexible conduit is fed through curved guide means 32. After the flexible conduit 22 has been fed through curved guide means 32, the lubricator 122 may be disconnected to place a nozzle 24 on the end of the flexible conduit 22. The lubricator 122 is reconnected. The system is now ready to begin the injection of the flexible conduit 22 into the well 10.

The operation of the injection system is straightforward. The master valve is opened. As described in the aforementioned Laky U.S. Pat. No. 3,866,679, fluid is pumped through the flexible conduit 22 to prevent its collapse and to aid its passage through the well bore. The injector drive means 28 is powered, as described in the aforementioned patent, to inject the flexible conduit 22 into the well. While the conduit 22 is being injected, storage means 134 plays out additional conduit 22. The conduit is guided in its movement from storage means 134 to the injector drive means 28 by the rollers 148 and 150 of the first guide assembly 146, the pulley 152 and fair lead guide assembly 154. Seal means 30 attached to the inlet flange 92 of the injector drive assembly 28 prevent well fluids from escaping through the injector drive assembly 28. When a coupling of the flexible conduit 22 advances to the seal means 30, first one stuffing box 90 is opened to admit the coupling and closes after it has passed, and then the second stuffing box 88 opens and closes as the coupling passes therethrough. In this manner, seal means 30 is always effective. Within the injector drive means 28, the flexible conduit 22 is engaged and a driving force is imparted to it to inject it into the well. The flexible conduit 22 is moved through the tubular means 130, the curved guide means 32, the lubricator 122 and connector means 26 into the well. As the flexible conduit 22 passes through the curved guide means 32, its direction of movement is changed between a direction of movement in alignment with the injector drive means 28 and a direction of movement in alignment with the well 10. Roller means 44 within the curved guide means 32 engage the flexible conduit as it passes therethrough, and enable the flexible conduit 22 to change its direction of movement without damage to the conduit's exterior. From the curved guide means 32, the flexible conduit passes straight through the lubricator 122 and the christmas tree into the well 10.

Once in the well, the flexible conduit may be used to wash out sand bridges or otherwise treat the well. To do so, fluid is pumped through the flexible conduit in the manner described in the aforementioned Laky U.S. Pat. No. 3,866,679.

After the well has been treated, the flexible conduit is retrieved. To retrieve the flexible conduit 22 from the well, the injector drive means 28 is reversed. The reversed injector drive means 28 imparts a force to pull the flexible conduit 22 from the well. Storage means 134 accumulates the flexible conduit 22 as it is retrieved from the well. During the retrieval, the measuring device 156 is monitored. To prevent breakage of the flexible conduit 22 or damage to the curved guide means 32, when all but a couple hundred feet of the flexible conduit 22 have been retrieved, the rate of retrieval is slowed. Retrieval is thereafter closely monitored and is immediately stopped when it is sensed that the nozzle 24 is within the lubricator 122 above the master valve 18. The master valve 18 is closed and the lubricator 122 may be disconnected. With the lubricator 122 disconnected, the nozzle may be taken off of the flexible conduit 22.

During retrieval, the wiper rings of wiper means 94 strips the well fluids from the conduit's exterior surface.

If desired, rather than accumulating all of the flexible conduit on storage means 134, a portion may be left within curved guide means 32, tubular means 130, and injection drive means 28. To do so, couplings 24 of the flexible conduit 22 on both sides of these components may be disconnected leaving a portion therein. The remaining portion of the flexible conduit 22 may be accumulated and stored on storage means 134.

It should be readily understood that the wiper means 94 has been illustrated and described as being attached directly to the injector drive means 28 because this is normally the most convenient location for it. However, the wiper means can be located ay any convenient place between the lubricator 122 and the injector drive means 28. For instance, if it is expected that trash or the like will be wiped from the hose by the wiper, then the wiper means is preferably connected between the upper lubricator section 122*b* and the curved guide means 32. Thus, any trash or debris carried upwardly on the exterior of the hose will be wiped therefrom by the wiper means and allowed to gravitate back into the well rather than collecting and packing in the wiper means as may occur when the wiper means is connected as shown in the drawing. When the wiper means is connected at a location other than as shown in FIG. 1 of the drawing, it must understandably be provided with suitable fittings on its ends adapting it for such connection.

It was earlier stated that the tubular means 130 may comprise a pipe section rather than a flexible hose as shown in the drawing. When a pipe section is used here in the stead of the flexible hose as shown, alignment of the injector drive means 28 with the curved guide means 32 may be difficult. Therefore, it is preferred to install a fluid tight, pressure competent adjustable union (not shown) either between the wiper means 94 and the pipe section 130 or somewhere between the blowout preventer 33 and the curved guide means 32, or, preferably, in both such locations. Such adjustable union is illustrated in the Composite Catalog of Oilfield Equipment and Services, 1974–75 Ed. on page 3916 and is obtainable from Otis Engineering Corporation, Dallas, Texas.

From the foregoing, it may be seen that the objects of this invention have been obtained. There has been provided a system for injecting a flexible conduit into a well. The system does not require the use of heavy hoisting equipment. Even though the system includes heavy components, the heavy components are readily movable from one location to another. The system enables the flexible conduit to be guided between a direction of motion aligned with the well and a direction of motion not aligned with the well. The guide for changing such directional movement supports that portion of the conduit which is undergoing a change in directional motion while having minimal frictional engagement therewith. Additionally, the guide is easy to assemble.

The foregoing disclosure and description of the invention are illustrative and explanatory thereof, and various changes in the size, shape and materials, as well as in the details of the illustrated construction, may be made within the scope of the appended claims without departing from the spirit of the invention.

What is claimed is:

1. A system for injecting flexible conduit into a well against the pressure of the well, the system comprising:

connector means attached to the well and in communication with the well and aligned with the well for providing a passage aligned with the well through which a flexible conduit may be injected into the well;

injector drive means for engaging the flexible conduit, injecting it against the pressure of the well into the well, and retrieving it from the well;

said injection drive means imparting movement to the flexible conduit in a direction which is not aligned with the well;

seal means in fluid communication with said injector drive means for sealing with the flexible conduit to prevent well fluids from escaping from said injector drive means;

curved guide means in fluid communication with both of said connector means and said injector drive means for guiding the movement of the said flexible conduit, while the flexible conduit is subject to the pressure of the well, between said injector drive means and said connector means;

storage means for storing the flexible conduit which will be injected into the well;

fair lead guide means for guiding the movement of the flexible conduit between said storage means and said injection drive means;

measuring means for measuring the amount of flexible conduit that is injected into or retrieved from the well; and common skid frame means for supporting each of said injector drive means, storage means, fair lead guide means, seal means, and measuring means independently from the well; and wherein said curved guide means includes:

curved tubular housing means capable of withstanding the pressure of the well and having an internal, curved passage through which the flexible conduit may pass, a plurality of roller means disposed within the curved passage of said curved housing means for guiding said flexible conduit through said curved passage with a minimal amount of frictional engagement, and mounting means for mounting said roller means in a substantially precise hyperbolic curve in said curved passage, said mounting means including a plurality of roller housing means for housing said roller means with each roller housing means housing two roller means, a plurality of link means with each of said link means linking together two of said roller housing means, and means for anchoring the ends of said mounting means to said curved housing.

2. A system for injecting flexible conduit into a well against the pressure of the well, the system comprising:

storage means for storing the flexible conduit which will be injected into the well;

injector drive means for engaging the flexible conduit, injecting it against the pressure of the well into the well, and retrieving it from the well;

seal means in fluid communication with said injector drive means for sealing with the flexible conduit and for preventing well fluids from escaping;

common frame means for supporting said storage means and said injector drive means independently of the well; and curved guide means in fluid communication with both the well and said injector drive means with one end of said curved guide means being aligned with the well and the other end being aligned with the injector drive means for guiding the movement of the flexible conduit, while the flexible conduit is subject to the pressure of the well, between said injector drive means and the well; and wherein said curved guide means includes:

curved tubular housing means capable of withstanding the pressure of the well and having an internal, curved passage through which the flexible conduit may pass, a plurality of roller means disposed within the curved passage of said curved tubular housing means for guiding said flexible conduit through said curved passage with a minimal amount of frictional engagement, and mounting means for mounting said roller means in a substantially precise hyperbolic curve in said curved passage, said mounting means including a plurality of roller housing means for housing said roller means with each roller housing means housing two roller means, a plurality of link means with each of said link means linking together two of said roller housing means, and means for anchoring the ends of said mounting means to said curved housing.

3. The system of claim 2 additionally including:

fair lead guide means for guiding the movement of the flexible conduit between said storage means and said injector drive means;

measuring means for measuring the amount of flexible conduit that is injected into or retrieved from the well; and wherein said frame means supports each of said injector drive means, storage means, fair lead guide means, seal means, and measuring means.

4. A system for injecting a flexible conduit into a well bore against the pressure of the well, the system comprising:

injector drive means in fluid communication with the well and engaging the flexible conduit for injecting the conduit against the pressure of the well into the well and for retrieving the flexible conduit from the well;

seal means in fluid communication with said injector drive means for sealing with the flexible conduit to prevent well fluids from escaping through said injector drive means;

said injector drive means being positioned with respect to the well so that the flexible conduit, as it leaves said conduit injector drive means is not aligned with the well bore;

curved guide means in fluid communication with both the well and said injector drive means for guiding the movement of the flexible conduit, while the flexible conduit is subject to the pressure of the well, between a direction which is aligned with said injector drive means and a direction which is aligned with the well; and wherein said curved guide means includes:

curved tubular housing mens capable of withstanding the pressure of the well and having an internal curved passage through which the flexible conduit may pass, a plurality of roller means disposed within the curved passage of said curved tubular housing means for guiding said flexible conduit through said curved passage with a minimal amount of frictional engagement, and mounting means for mounting said roller means in a substantially precise hyperbolic curve in said passage, said mounting means including a plurality of roller housing means for housing said roller means with each roller housing means housing two roller means, a plurality of link means with each of said link means linking together two of said roller housing means, and means for anchoring the ends of said mounting means to said curved housing; and frame means for supporting said injector drive means independently from the well.

5. The system of claim 4 additionally including:

storage means for storing the flexible conduit which will be injected into the well;

fair lead guide means for guiding the movement of the flexible conduit between said storage means and said injector drive means;

measuring means for measuring the amount of flexible conduit that is injected into or retrieved from the well; and wherein said frame means additionally supports said storage means, fair lead guide means, seal means, and measuring means.

6. A curved guide for guiding the movement of a flexible member, under pressure, around a curve with minimal frictional engagement, the curved guide comprising:

tubular housing means curved in a substantially precise hyperbolic curve and having a substantially precise hyperbolic curved internal passage through which the flexible member may pass;

a plurality of roller means disposed within the internal passage of said housing means;

mounting means for mounting said roller means within the internal passage along a substantially precise hyperbolic curve, said mounting means including:

bearing means for each end of each roller means, a plurality of roller housing means for housing said roller means, each roller housing means retaining the bearing means of two adjacent roller means to thereby house two of said roller means, a plurality of link means for linking together said roller housing means, each link means linking together two roller housing means by retaining the bearing means of two adjacent roller means, said two adjacent roller means retained by said link means being different from the two adjacent roller means retained in said roller housing means, and whereby said roller means may be mounted in said housing means with each of said two adjacent roller means housed within one of said roller housing means also being retained within two different link means and with each of said two adjacent roller means retained within one of said link means also being housed within two different roller housing means.

7. A curved guide for guiding a flexible member, under pressure, around a curve with minimal frictional engagement, the curved guide comprising:

curved tubular housing means having a substantially precise hyperbolic, curved internal passage through which the flexible member may pass;

a plurality of roller means disposed within the internal passage of said curved housing means; and mounting means for mounting said roller means within the internal passage along a substantially precise hyperbolic curve, said mounting means including:

bearing means for each end of each roller means, a plurality of link plate means, each link plate means retaining two of said bearing means, one end of two adjacent roller means being mounted within the bearing means retained in one of said link plate means, the other end of each of said two adjacent roller means being mounted within the bearing means retained in another of said link plate means, a plurality of roller housing means, each of which houses two adjacent roller means, each roller housing means including two pairs of opposed slots with each of said pair of opposed slots being adapted to receive the two bearing means on each end of one of said roller means, whereby said roller means may be mounted in said curved tubular housing means in chain-link fashion with each of said two adjacent roller means retained by an opposed pair of link plate means also being housed within two different roller housing means and with each of said two adjacent roller means housed within one roller housing means also being retained by different opposed pairs of link plate means.

8. A curved guide for guiding the passage of a flexible member around a curve with minimal frictional engagement and minimal damage, the curved guide comprising:

tubular housing means curved in a substantially precise hyperbolic curve and having a substantially precise hyperbolic curved internal passage through which the flexible member may pass;

a plurality of roller means disposed within the internal passage of said housing means;

mounting means for mounting said roller means within the internal passage along a substantially precise hyperbolic curve, said mounting means including:

bearing means for each end of each of said roller means, a plurality of roller housing means for housing two adjacent roller means, each of roller housing means having two pairs of opposed slots in which said bearing means of said two adjacent roller means may be received; and a plurality of link means for linking together said roller housing means with each link means linking together two adjacent roller housing means by retaining two adjacent roller means, whereby said roller means may be mounted in said curved tubular housing means in chain-link fashion with each of said two adjacent roller means housed within one roller housing means being retained by two different link means and with each of said two adjacent roller means retained by one link means being housed within two different roller housing means.

9. A system for injecting a flexible conduit into a well bore against the pressure of the well, the system comprising:

injector drive means in fluid communication with the well and engaging the flexible conduit for injecting the conduit against the pressure of the well into the well and for retrieving the flexible conduit from the well;

seal means in fluid communication with said injector drive means for sealing with the flexible conduit to prevent well fluids from escaping through said injector drive means;

said injector drive means being positioned with respect to the well so that the flexible conduit, as it leaves said injector drive means, is not aligned with the well bore;

frame means for supporting injector drive means independently from the well; and curved guide means in fluid communication with both the well and said injector drive means for guiding the movement of the flexible conduit, while the flexible conduit is subject to the pressure of the well, between a direction which is aligned with said injector drive means and a direction which is aligned with the well;

said curved guide means including:

curved tubular housing means having a substantially precise hyperbolic, curved internal passage through which the flexible conduit may pass, a plurality of roller means disposed within the internal passage of said curved housing means, and mounting means for mounting said roller means within the internal passage along a substantially precise hyperbolic curve, said mounting means including bearing means for each end of each roller means, a plurality of link plate means, each link plate means retaining two of said bearing means, one end of two adjacent roller means being mounted within the bearing means retained in one of said link plate means, the other end of each of said two adjacent roller means being mounted within the bearing means retained in another of said link plate means, a plurality of roller housing means, each roller housing means housing two adjacent roller means and including two pairs of opposed slots with each of said pair of opposed slots being adapted to receive the two bearing means on each end of one of said roller means, whereby said roller means may be mounted in said curved tubular housing means in chain-link fashion with each of said two adjacent roller means retained by an opposed pair of link plate means also being housed within two different roller housing means and with each of said two adjacent roller means housed within one roller housing means also being retained by different opposed pairs of link plate means.

* * * * *